United States Patent [19]

Bauer et al.

[11] 4,062,740

[45] Dec. 13, 1977

[54] BATH FOR DIRECT CHROME-PLATING OF CALENDER ROLLS

[76] Inventors: Wilhelm Bauer, Am Wohren 1; Hans Bauer, Susseroder Strasse 45, both of 3000 Hannover 73, Germany

[21] Appl. No.: 759,457

[22] Filed: Jan. 14, 1977

[30] Foreign Application Priority Data

Feb. 20, 1976 Germany ..... 2606852

[51] Int. Cl.[2] ..... C25D 3/04; C25D 3/56; C25D 7/00

[52] U.S. Cl. ..... 204/51; 204/25; 204/44

[58] Field of Search ..... 204/51, 44, 105 R, 123, 204/25

[56] References Cited

U.S. PATENT DOCUMENTS 2,962,428 11/1960 Passal ..... 204/51

*Primary Examiner*—G. L. Kaplan

*Attorney, Agent, or Firm*—Warren, Chickering & Grunewald

[57] ABSTRACT

An electrolytic bath for direct chrome-plating of calender rolls is disclosed to which potassium aluminum sulfate and copper sulfate are added in order to increase the strength and stability of the chrome-plated layer deposited on the calender rolls.

4 Claims, No Drawings

BATH FOR DIRECT CHROME-PLATING OF CALENDER ROLLS

Calender rolls, especially those intended for the production of plastic foils, must be chrome-plated to give them a shell surface as smooth and uniform as possible. Traditionally, the chrome layer is applied by direct galvanizing, i.e., without any intermediae layer on the basic material of the rolls (steel or cast iron). Galvanic baths are used for this purpose, containing chromic acid ($CrO_3$) and sulfuric acid ($H_2SO_4$) in a water solution (so-called "chromic acid electrolytes") having additional contents of fluosilicic acid ($H_2SiF_6$) to improve the deposit speed (so-called "mixed acid electrolytes").

It has been found that sufficient stability and strength in the chrome-plating cannot be attained with the known baths. The chrome layers which may be 30 to 300 μm thick appear to be perfect when the roll is taken from the bath, but at the first use of the roll in the calender, we often find surprising and despite previous testing unforeseen formation of macro-cracks. These cracks make the roll useless, since they result in defective foils. The respective rolls must, therefore, be removed from the calender and replaced by new rolls, which involves considerable expense. The waste quota is relatively high, thus putting a marked additional burden on the production cost of the rolls.

Direct chrome-plating of iron or steel objects has actually been known for a long time. However, the processes so far applied successfully to chrome-plating of other objects cannot be equally applied to chrome-plating of calender rolls, since the chrome layer on a calender roll must withstand considerable stress of temperature and pressure as well as shearing stress not present in other objects. For other chromed objects it is usually only important to produce a corrosion protected and an aesthetically acceptable surface with the chrome-plating, so that the processes there applied do not give us any indication as to how to improve the chrome-plating of calender rolls.

Consequently, to this date we have accepted the high waste quota of chrome-plated calender rolls as inevitable. But the present invention eliminates this inconvenience. In said invention, a galvanic bath is provided which contains the usual components of chromic acid electrolytes and mixed acid electrolytes for direct chrome-plating of calender rolls and which is distinguished as a novel invention by its additional contents of copper sulfate (e.g., $CuSo_4.5H_2O$) and potassium aluminum sulfate [e.g., $KAl(SO_4)_2.12H_2O$]. In this case, we prefer to use about 0.3 to about 0.5 weight percent (wt.%) of potassium aluminum sulfate and up to about 0.1 weight percent (wt.%) copper sulfate, each referred to the contents of chromic acid.

Surprisingly, it was discovered that with the bath according to this invention, at essentially the same other electrolytic conditions, a much more stable chrome layer can be produced on the calender rolls and that in particular the tendency towards macro-cracks, which has been frequent during the first use of the rolls and could not be recognized in advance, vanished to a large extent. This lowers the waste-quota considerably, and the production of the calender rolls is less expensive. This function of the additions of copper sulfate and potassium aluminum sulfate to the electrolytic bath could neither be anticipated nor can it be explained.

We found that it is advisable, as compared to the customary chromic acid electrolytes, or mixed acid electrolytes containing about 2.5 weight percent (wt.%) sulfuric acid, to reduce the content of the sulfuric acid an amount equal to the $SO_4$— — ions which get into the bath from the copper sulfate and potassium aluminum sulfate, i.e., by an amount to keep the $SO_4$— — ion concentration of the bath essentially the same as that of a regular bath. This enhances the effect of the addition of copper sulfate and potassium aluminum sulfate.

EXAMPLE

The invention is explained hereafter in detail in one example of execution.

A galvanic bath of the following composition has been made:

250 g: chromic acid
1.0 – 1.25 g: potassium aluminum sulfate
0.25 g: copper sulfate
2.0 g: sulfuric acid, free of water
6 ml: fluosilicic acid commercial type (about 35%)
add 1 l: water.

With this bath, calender rolls were chrome-plated at a temperature between about 50° to 60° C and at current densities of about 20 and 100 A/dm². The duration of the chrome-plating was determined by the desired thickness of the layer and density of the current, whereas the density of the current was on the other hand influenced by the size of the work piece. The chrome layer was deposited as usual, without an intermediate layer, directly onto the steel or cast iron, keeping the thickness of the layer within the usual range of about 30 to 300 μm.

In many chrome-platings made at these conditions, markedly stable chrome layers were obtained which led to less than 2 percent (%) waste in all calender rolls chromeplated.

For comparison, calender rolls were chrome-plated in a usual bath which was distinguished from the above-mentioned in that it did not contain any copper sulfate nor potassium aluminum sulfate and that 2.5 g sulfuric acid were used instead of 2 g. The other process conditions were the same. The chrome layers thus obtained were much less stable, the waste rate of the thus-produced calender rolls was around 20 percent (%). The invention therefore lowers the waste rate by a power of 10.

What is claimed is:

1. A bath for direct chrome-plating of calender rolls, consisting of an aqueous solution containing chromic acid ($CrO_3$), sulfuric acid ($H_2SO_4$) and fluosilicic acid ($H_2SiF_6$), wherein the improvement in said bath comprises:

copper sulfate ($CuSO_4$) and potassium aluminum sulfate [$KAl(SO_4)_2$].

2. A bath for chrome-plating as defined in claim 1 wherein, the content of potassium aluminum sulfate in said bath ranges from about 0.3 to about 0.5 weight percent (wt.%) and the content of copper sulfate ranges up to about 0.1 weight percent (wt.%) of the contents of chromic acid of said bath.

3. A bath for chrome-plating as defined in claim 2 wherein, the amount of sulfuric acid in said bath is reduced to the extent to which $SO_4$— — ions are present in said bath in said copper sulfate and said potassium aluminum sulfate.

4. A bath for chrome-plating as defined in claim 1 wherein, the amount of sulfuric acid in said bath is reduced to the extent to which $SO_4$— — ions are present in said bath in said copper sulfate and said potassium aluminum sulfate.

* * * * *